US006347410B1

(12) United States Patent
Lee

(10) Patent No.: US 6,347,410 B1
(45) Date of Patent: Feb. 19, 2002

(54) SELF-SIZING BASEBALL CAP

(76) Inventor: Razgo Lee, 22125 Birds Eye Dr., Diamond Bar, CA (US) 91765

( * ) Notice: Subject to any disclaimer, the term of this patent is extended or adjusted under 35 U.S.C. 154(b) by 0 days.

(21) Appl. No.: 09/881,177

(22) Filed: Jun. 14, 2001

Related U.S. Application Data

(60) Provisional application No. 60/260,988, filed on Jan. 11, 2001.

(51) Int. Cl.[7] ..... A42B 1/00
(52) U.S. Cl. ..... 2/181; 2/195.1
(58) Field of Search ..... 2/175.1, 195.1, 2/181, 209.13, DIG. 11

(56) References Cited

U.S. PATENT DOCUMENTS 2,122,561 A * 7/1938 Dolan ..... 2/183
2,477,240 A * 7/1949 Elishewitz ..... 2/181
2,577,717 A * 12/1951 Stevens ..... 2/183
2,584,094 A * 1/1952 Sailer ..... 2/183
5,615,415 A 4/1997 Beckerman
5,632,046 A * 5/1997 Green et al. ..... 2/183
5,715,540 A 2/1998 Cho
5,966,742 A 10/1999 Cunliffe

* cited by examiner

*Primary Examiner*—Bibhu Mohanty
(74) *Attorney, Agent, or Firm*—Chan Law Group LC

(57) ABSTRACT

The self-sizing baseball cap with a two or more piece, one or more layer sweatband satisfies the long recognized need of providing a baseball cap that fits a range of head sizes comfortably without any wearer adjustable cap sizing devices. This sweatband is flexibly attached to the self-sizing baseball cap so that it can be in either the stowed or deployed position when wearing the cap. When deployed, it creates an expanded self-adjustable attachment area on the wearer's head and provides more shade and warmth to the wearer. The two or more piece, one or more layer sweatband can be made from one or more than one different material with some or all materials biaxially or uniaxially stretchable. Each piece of the sweatband can be a different color or the same color as the other sweatband pieces.

32 Claims, 2 Drawing Sheets

SELF-SIZING BASEBALL CAP

This appln claims benefit of Prov. No. 60/260,988 filed Jan. 11, 2001.

BACKGROUND OF THE INVENTION

1. Field of the Invention

The present invention relates to an improved construction of a baseball cap, capable of fitting wearers having a plurality of head sizes. The cap includes a crown portion fabricated from a multi-gore shell, a visor portion connected to the front of the crown portion, and a two or more piece, and one or more layer sweatband. The stowable or deployable stretchable sweatband permits the cap to fit onto the head of the wearer without uncomfortable circumferential pressure.

2. Description of Related Art

Visored or baseball type caps are well known in the art and come in many configurations. They include a hemispherical crown portion to fit onto a wearer's head and a visor or bill portion attached to the front of the hemispherical crown portion. Several substantially triangular panels called gores are joined together with seams to form the crown.

There are many different types of caps that have been available over the years with various wearer adjustable features in order to fit a plurality of head sizes. This type generally has an opening in the base of the crown portion opposite the visor at the back of the cap. The opening generally has overlapping straps that are adjustably attached to each other to change the circumferential cap size to accommodate a multitude of head sizes. While the base of the hemispherical portion may be enlarged to accommodate the larger sized head, there must be an aperture formed in the rear of the cap that the overlapping straps span so that the entire hat can expand to the degree necessary to fit the larger head. Therefore, the rear portion of the cap is not of a uniform construction and the forming of the opening or vent creates not only a loss of material but greater difficulty manufacturing the cap.

In most of the prior art caps that incorporate what might be considered stretchable fabric, the desired level of comfort and easy of use to the wearer has not been achieved. The cap causes undo compressive pressure around the head of the wearer thereby causing discomfort to the wearer and even resulting in the cap leaving a mark on the wearer's skin.

The present invention can be distinguished from U.S. Pat. No. 5,615,415, A Custom-fit Cap. "A custom-fit cap having a visor portion and a substantially hemispherical crown portion attached to the visor portion and at least a crown portion opposite the visor and covering the back of the head being formed of the material that stretches at least circumferentially about the crown portion for accommodating various head sizes. A band that is stretchable circumferentially and is attached to the inside of the hemispherical crown portion adjacent the base thereof forms a sweatband to engage the head of the user while allowing the cap to stretch circumferentially with at least that portion of the crown portion covering the back of the head opposite the visor, so as to enable the cap to self-adjust automatically to fit a plurality of head sizes." The present invention incorporates a distinctive deployable or stowable two or more piece, one or more layer sweatband that can have one or more stretchable or all sections stretchable or some of the sections stretchable. When deployed the two or more piece, one or more layer sweatband allows for a self-adjustable expanded attachment area on the wearer's head and provides more shade and warmth to the wearer. The deployed two or more piece, one or more layer sweatband can be multiple colors, or a single color and it can match or be in contrast to the colors of the cap. U.S. Pat. No. 5,615,415 incorporates a one-piece non-deployable sweatband.

The present invention can be distinguished from U.S. Pat. No. 5,715,540, A Free-size cap. "A free-size cap is capable of fitting wearers having a range of head sizes. The cap includes a multi-gore shell forming a crown portion, and a visor or bill portion connected to the crown portion. Ones of the gores forming the multi-gore shell are composed of a uniaxially stretchable woven material capable of being stretched only along the chordial axis of said multi-gore shell. The free-size cap has the aesthetic appeal of a fixed-size style cap, being capable of custom fitting all wearers within a predetermined range of head sizes, without requiring an adjustable fastener portion or an open portion on the back of the cap. An advantage of this free-size cap is that it is capable of custom fitting all wearers within a predetermined range of head sizes, without the drawback of changes in shape due to differences in head size." The present invention incorporates a distinctive deployable or stowable two or more piece, one or more layer sweatband that can have one or more stretchable or all sections stretchable or some of the sections stretchable. When deployed the two or more piece, one or more layer sweatband allows for a self-adjustable expanded attachment area on the wearer's head and provides more shade and warmth to the wearer. The deployed two or more piece, one or more layer sweatband can be multiple colors, or a single color and it can match or be in contrast to the colors of the cap. U.S. Pat. No. 5,715,540 incorporate a one-piece non-deployable sweatband and relies upon a confining uniaxially stretchable crown portion to provide adjustable fit.

The present invention can be distinguished from U.S. Pat. No. 5,966,742, An Adjustable Cap. "An adjustable cap has a crown portion shaped for fitting over the crown of a wearer's head, with the rear part of the crown portion formed of a stretchable material. A two part peripheral band is secured around the lower peripheral edge of the crown portion on the inside of the cap. The first, front part of the band is of a moisture absorbent, non-stretch material, and the second, rear part extending across the rear of the crown portion is of a stretchable material. The rear part of the band stretches to adjust the size of the peripheral opening to fit wearer's of differing head sizes." The present invention incorporates a distinctive deployable or stowable two or more piece, one or more layer sweatband that can have one or more stretchable or all sections stretchable or some of the sections stretchable. When deployed the two or more piece, one or more layer sweatband allows for a self-adjustable expanded attachment area on the wearer's head and provides more shade and warmth to the wearer. The deployed two or more piece, one or more layer sweatband can be multiple colors, or a single color and it can match or be in contrast to the colors of the cap. U.S. Pat. No. 5,966,742 incorporates a two piece non-deployable sweatband and relies upon only a confining biaxially stretchable aft sweatband portion to provide adjustable fit.

An objective of the present invention is to overcome the disadvantages of the prior art by providing a custom-fit comfortable cap having no vent and no adjustable straps at the back thereof and yet which can accommodate a plurality of various sized heads.

It is still another important objective of the present invention is to provide a cap which has a self-adjustable expanded attachment area on the wearer's head and provides more shade and warmth to the wearer and the sweatband can be multiple colors, or a single color and it can match or be in contrast to the colors of the cap.

It is a further objective of the present invention to provide a baseball-type cap structure capable of multi-sizing in use, which can be manufactured easily utilizing conventional materials and fabrics, and which is both functional and attractive in its use and appearance.

It is still a further objective of the present invention to decrease the quantity of retail cap stock necessary to accommodate a plurality of various sized heads.

BRIEF SUMMARY OF THE INVENTION

The invention is a self-sizing baseball cap. The self-sizing baseball cap includes a plurality of fabric gores of substantially triangular shape. Each fabric gore has a first side, a second side and third side. A crown portion is created by attaching the first side of the gore to the second side of another adjacent gore and so forth until the creation of a closed section of essentially hemispherical shape. The crown portion has an inner surface and an outer surface and a lower peripheral edge. The lower peripheral edge has a forward portion, a forward midpoint, an aft portion, an aft midpoint and a circumferential linear perimeter of a first predetermined length.

A visor of an essentially rigid nature is attached to the forward portion of the lower peripheral edge.

A sweatband is provided. The sweatband is shaped as an elongated rectangle and has an upper edge, a lower edge, a first edge, a second edge, a forward sweatband midpoint and a first predetermined width. The sweatband is joined at its first edge and its second edge to form a continuous loop.

The sweatband is attached to the lower peripheral edge so that the forward sweatband mid point coincides with the forward midpoint and the aft sweatband midpoint coincides with the aft midpoint.

The attachment of the lower edge of the sweatband to the lower peripheral edge possesses a flexibility that permits the sweatband loop to be in the stowed or deployed position when wearing the self-sizing baseball cap. The stowed position has the outer surface of sweatband flush against the inner surface of the crown portion. The deployed position has the outer surface of the sweatband flush against the head of the wearer of the self-sizing baseball cap.

In a variation of the invention, the first predetermined length comes in a short and a long length to accommodate a range of head sizes comfortably. The short length is sized to fit small to medium size heads comfortably. The long length is sized to fit large to extra large size heads comfortably.

In another variation of the invention, the sweatband is created from two or more layers. Each layer is shaped as an elongated rectangle with an upper edge, a lower edge, a first edge, a second edge, an inner surface, an outer surface, and a first predetermined width.

The two or more layer sweatband has an inner layer and an outer layer. The outer surface of the inner layer being attached to the inner surface of the outer layer.

In yet another variation of the invention, each sweatband layer is made from different materials.

In still another variation of the invention, each sweatband layer is made from the same material.

In a different variation of the invention, the inner surface of the inner layer of the sweatband is made from a material that feels comfortable to a wearer during long term contact with the wearer's skin or hair.

In another different variation of the invention, the outer surface of the outer layer of the sweatband is made from a material that feels comfortable to a wearer during long term contact with the wearer's skin or hair.

In yet a different variation of the invention, each sweatband layer is either sweat absorbent or non-sweat absorbent.

In still a different variation of the invention, the inner layer is uniaxially stretchable.

In still another different variation of the invention, the inner layer is biaxially stretchable.

In distinctive variation of the invention, the outer layer is uniaxially stretchable.

In another distinctive variation of the invention, the outer layer is biaxially stretchable.

A second version of the invention is a self-sizing baseball cap. This self-sizing baseball cap includes a plurality of fabric gores of substantially triangular shape. Each fabric gore has a first side, a second side and third side. A crown portion is created by attaching the first side of the gore to the second side of another adjacent gore and so forth until the creation of a closed section of essentially hemispherical shape. The crown portion has an inner surface and an outer surface and a lower peripheral edge. The lower peripheral edge has a forward portion, a forward midpoint, an aft portion, an aft midpoint and a circumferential linear perimeter of a first predetermined length.

A visor of an essentially rigid nature is attached to the forward portion of the lower peripheral edge.

A sweatband is provided. The sweatband is created from two or more sweatband segments. Each sweatband segment is shaped as an elongated rectangle with an upper edge, a lower edge, a first edge, and a second edge and a first predetermined width.

The first edge of the sweatband segment is attached to the second edge of an adjacent sweatband segment and so forth to create a closed loop, two or more piece the sweatband. The sweatband has an inner surface, an outer surface and a circumferential linear extent of a first predetermined length.

The sweatband is attached to the lower peripheral edge so that the forward sweatband mid point coincides with the forward midpoint and the aft sweatband midpoint coincides with the aft midpoint.

The attachment of the lower edge of the sweatband to the lower peripheral edge possesses a flexibility that permits the sweatband loop to be in the stowed or deployed position when wearing the self-sizing baseball cap. The stowed position has the outer surface of sweatband flush against the inner surface of the crown portion. The deployed position has the outer surface of the sweatband flush against head of the wearer of the self-sizing baseball cap.

In a variation of the invention, the first predetermined length comes in a short and a long length to accommodate a range of head sizes comfortably. The short length is sized to fit small to medium size heads comfortably. The long length is sized to fit large to extra large size heads comfortably.

In yet another distinctive variation of the invention, each sweatband segment is a different color or the same color as the other the sweatband segments.

In still another distinctive variation of the invention, the sweatband segment is sweat absorbent.

In a discrete variation of the invention, a sweatband segment is non-sweat absorbent.

In another discrete variation of the invention, a sweatband segment is uniaxially stretchable.

In yet another discrete variation of the invention, a sweatband segment is biaxially stretchable.

In a distinguishable variation of the invention, each sweatband segment is made from different materials.

In another distinguishable variation of the invention, each sweatband segment is made from the same material.

In yet another distinguishable variation of the invention, each sweatband segment is created from two or more layers. Each sweatband segment layer is shaped as an elongated rectangle with an upper edge, a lower edge, a first edge, a second edge, an inner surface, an outer surface, and a first predetermined width.

The two or more layer sweatband segment has an inner layer and an outer layer. The outer surface of the inner layer is attached to the inner surface of the outer layer.

In still another distinguishable variation of the invention, each sweatband segment layer is made from a different material than another sweatband segment layer.

In a discernable variation of the invention, each sweatband segment layer is made from the same material.

In another discernable variation of the invention, the inner surface of the inner layer of the sweatband segment layer is made from a material that feels comfortable to a wearer during long term contact with the wearer's skin or hair.

In yet another discernable variation of the invention, the outer surface of the outer layer of the sweatband segment layer is made from a material that feels comfortable to a wearer during long term contact with the wearer's skin or hair.

In still another discernable variation of the invention, each sweatband segment layer is sweat absorbent or non-sweat absorbent.

In a hitherto discernable variation of the invention, the inner layer of each sweatband segment is uniaxially stretchable.

In another hitherto discernable variation of the invention, the inner layer of each sweatband segment is biaxially stretchable.

In yet another apparent variation of the invention, the outer layer of each sweatband segment is uniaxially stretchable.

In still another apparent variation of the invention, the outer layer of each sweatband segment is biaxially stretchable.

In another hitherto apparent variation of the invention, each sweatband segment layer is a different color or the same color as the other the sweatband segment layers.

Self-sizing baseball cap according to the present invention overcomes the aforementioned disadvantages of the known multi-size caps and of the fixed-size style caps. An advantage of the present invention is that it is capable of custom fitting all wearers within a predetermined range of head sizes without requiring an adjustable fastener portion or an open portion on the back of the cap. The invention meets the objective to provide a baseball-type cap structure capable of multi-sizing in use, which can be manufactured easily utilizing conventional materials and fabrics, and which is both functional and attractive in its use and appearance. A retailer only has to keep two sizes to be in stock small-medium and large-extra large. The present invention also has an aesthetic appeal over the adjustable strap open back type of caps. Further, the customer perceived quality of a self-sizing baseball cap versus hat styles that have manually adjustable sizes adds a great deal of customer perceived value and satisfaction with the cap. Also, the inventory of caps needed to meet consumer demands is substantially reduced.

DETAILED DESCRIPTION

Figure 1:
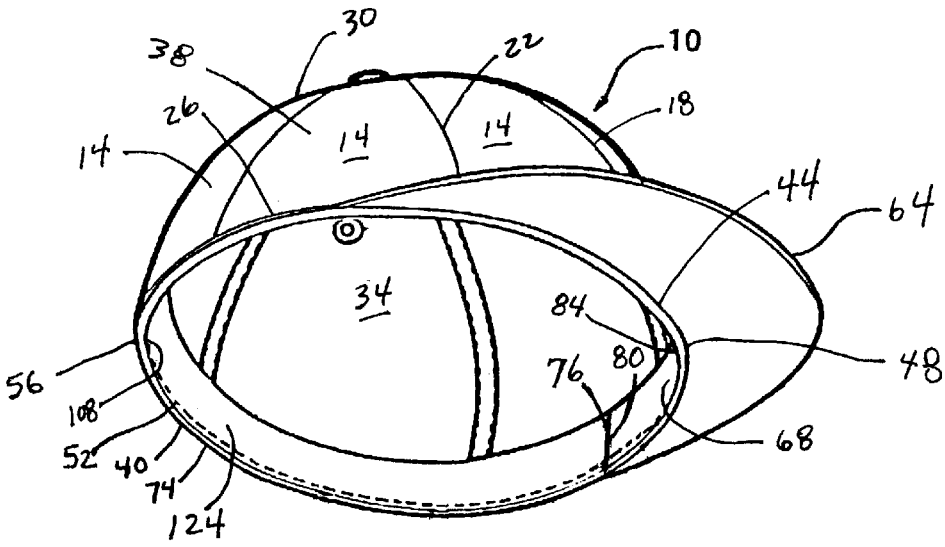
FIG. 1 is an orthogonal view from the bottom looking upwards into the inside of the cap with the one or more layer sweatband in the stowed position.
Figure 2:
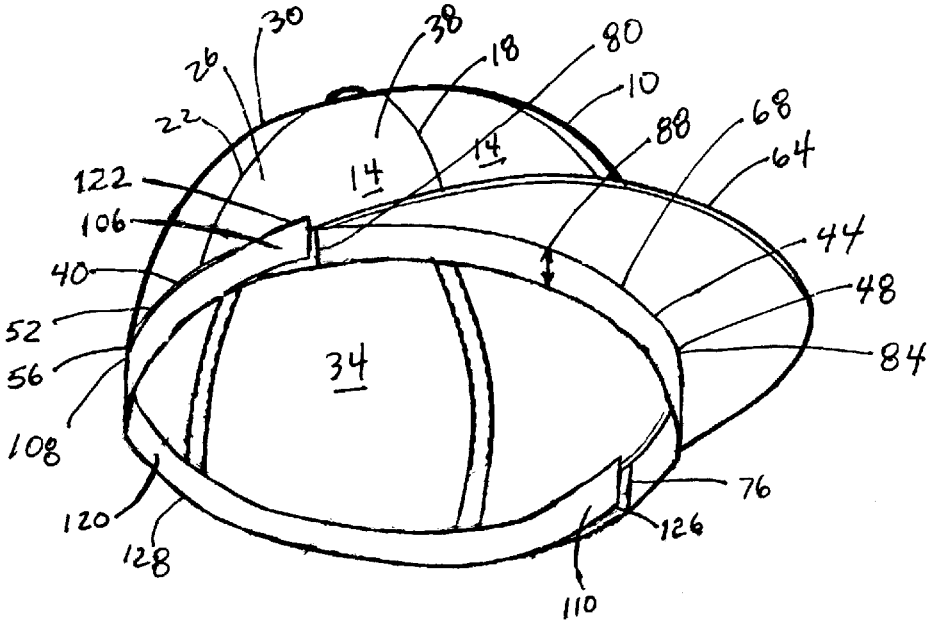
FIG. 2 is an orthogonal view from the bottom looking upwards into the inside of the cap with the one or more layer sweatband in the deployed position.

As shown in FIGS. 1 and 2, the invention is a self-sizing baseball cap 10. The self-sizing baseball cap 10 includes a plurality of fabric gores 14 of substantially triangular shape. Each fabric gore 14 has a first side 18, a second side 22 and third side 26. A crown portion 30 is created by attaching the first side 18 of the gore 14 to the second side 22 of another adjacent gore 14 and so forth until the creation of a closed section of essentially hemispherical shape. The crown portion 30 has an inner surface 34 and an outer surface 38 and a lower peripheral edge 40. The lower peripheral edge 40 has a forward portion 44, a forward midpoint 48, an aft portion 52, an aft midpoint 56 and a circumferential linear perimeter of a first predetermined length.

A visor 64 of an essentially rigid nature is attached to the forward portion 44 of the lower peripheral edge 40.

A sweatband 68 is provided. The sweatband 68 is shaped as an elongated rectangle and has an upper edge, a lower edge 74, a first edge 76, a second edge 80, a forward sweatband midpoint 84 and a first predetermined width 88. The sweatband is joined at its first edge 76 and its second edge 80 to form a continuous loop.

The sweatband 68 is attached to the lower peripheral edge 40 so that the forward sweatband mid point 84 coincides with the forward midpoint 48 and the aft sweatband midpoint 108 coincides with the aft midpoint 56.

The attachment of the lower edge 74 of the sweatband 68 to the lower peripheral edge 40 possesses a flexibility which permits the sweatband loop to be in the stowed 124 or deployed 128 position when wearing the self-sizing baseball cap 10. The stowed position 124 has the outer surface 120 of sweatband flush against the inner surface 34 of the crown portion 30. The deployed position 128 has the outer surface 120 of the sweatband flush against the head of the wearer of the self-sizing baseball cap 10.

In a variation of the invention, the first predetermined length comes in a short and a long length to accommodate a range of head sizes comfortably. The short length is sized to fit small to medium size heads comfortably. The long length is sized to fit large to extra large size heads comfortably.

In another variation of the invention, the sweatband 68 is created from two or more layers. Each layer is shaped as an elongated rectangle with an upper edge, a lower edge, a first edge, a second edge, an inner surface, an outer surface, and a first predetermined width.

The two or more layer sweatband has an inner layer 122 and an outer layer 124. The outer surface of the inner layer 122 is attached to the inner surface of the outer layer 124.

In yet another variation of the invention, each sweatband layer is made from different materials.

In still another variation of the invention, each sweatband layer is made from the same material.

In a different variation of the invention, the inner surface 106 of the inner layer 122 of the sweatband 68 is made from a material that feels comfortable to a wearer during long term contact with the wearer's skin or hair.

In another different variation of the invention, the outer surface 110 of the outer layer 126 of the sweatband 68 is made from a material that feels comfortable to a wearer during long term contact with the wearer's skin or hair.

In yet a different variation of the invention, each sweatband layer is either sweat absorbent or non-sweat absorbent.

In still a different variation of the invention, the inner layer 122 is uniaxially stretchable.

In still another different variation of the invention, the inner layer 122 is biaxially stretchable.

In distinctive variation of the invention, the outer layer 126 is uniaxially stretchable.

In another distinctive variation of the invention, the outer layer 126 is biaxially stretchable.

Figure 3:
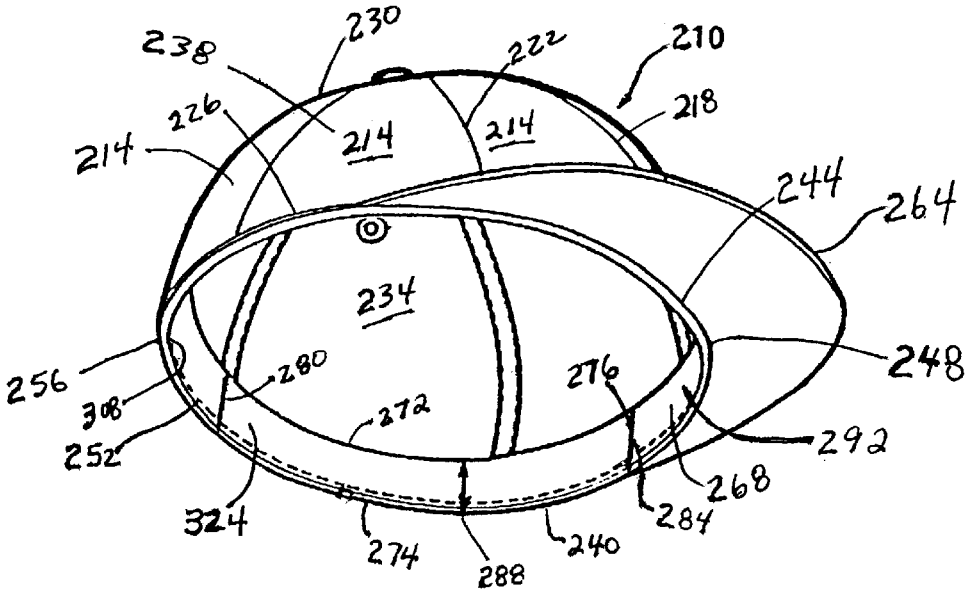
FIG. 3 is an orthogonal view from the bottom looking upwards into the inside of the cap with the two or more piece, one or more layer sweatband in the stowed position.
Figure 4:
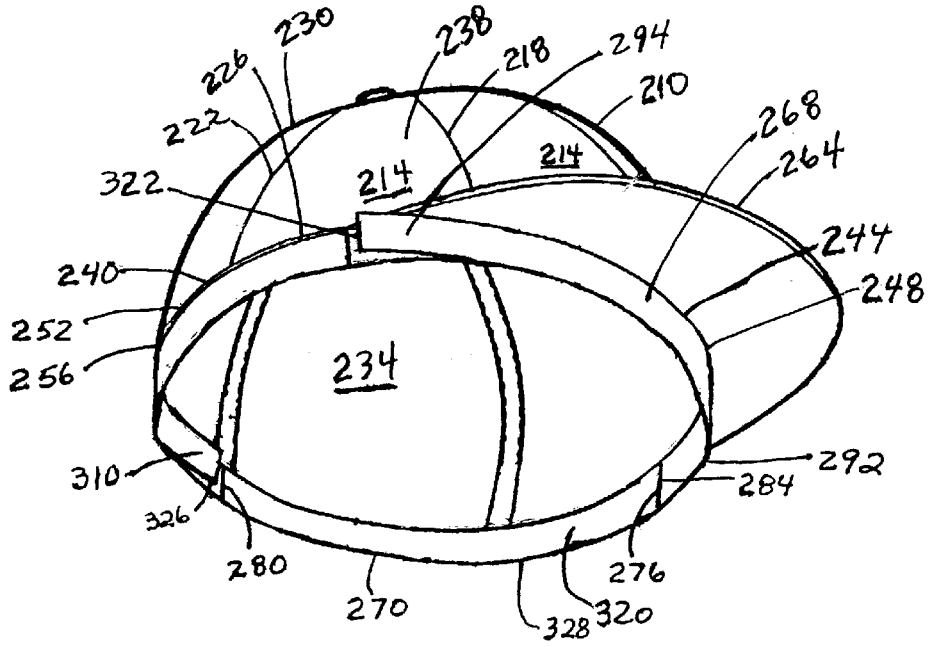
FIG. 4 is an orthogonal view from the bottom looking upwards into the inside of the cap with the two or more piece, one or more layer sweatband in the deployed position.

A second version of the invention, as shown in FIGS. 3 and 4, is a self-sizing baseball cap 210. The self-sizing baseball cap 210 includes a plurality of fabric gores 214 of substantially triangular shape. Each fabric gore 214 has a first side 218, a second side 222 and third side 226. A crown portion 230 is created by attaching the first side 218 of the gore 214 to the second side 222 of another adjacent gore 214 and so forth until the creation of a closed section of essentially hemispherical shape. The crown portion 230 has an inner surface 234 and an outer surface 238 and a lower peripheral edge 240. The lower peripheral edge 240 has a forward portion 244, a forward midpoint 248, an aft portion 252, an aft midpoint 256 and a circumferential linear perimeter of a first predetermined length.

A visor 264 of an essentially rigid nature is attached to the forward portion 44 of the lower peripheral edge 240.

A sweatband 268 is provided. The sweatband 268 is created from two or more sweatband segments 270. Each sweatband segment 270 is shaped as an elongated rectangle with an upper edge, a lower edge 274, a first edge 276, and a second edge 280 and a first predetermined width 288.

The first edge 276 of the sweatband segment 270 is attached to the second edge 284 of an adjacent sweatband segment 292 and so forth to create a closed loop, two or more piece the sweatband 268. The sweatband 268 has an inner surface, an outer surface 320 and a circumferential linear extent of a first predetermined length.

The sweatband 268 is attached to the lower peripheral edge 240 so that the forward sweatband mid point 284 coincides with the forward midpoint 248 and the aft sweatband midpoint 308 coincides with the aft midpoint 256.

The attachment of the lower edge 274 of the sweatband 268 to the lower peripheral edge 240 possesses a flexibility that permits the sweatband loop to be in the stowed 324 or deployed 328 position when wearing the self-sizing baseball cap 200. The stowed position 324 has the outer surface 320 of sweatband flush against the inner surface 234 of the crown portion 230. The deployed position 328 has the outer surface 320 of the sweatband flush against the head of the wearer of the self-sizing baseball cap 210.

In a variation of the invention, the first predetermined length comes in a short and a long length to accommodate a range of head sizes comfortably. The short length is sized to fit small to medium size heads comfortably. The long length is sized to fit large to extra large size heads comfortably.

In yet another distinctive variation of the invention, each sweatband segment 270 is a different color or the same color as the other the sweatband segments.

In still another distinctive variation of the invention, the sweatband segment 270 is sweat absorbent.

In a discrete variation of the invention, a sweatband segment 270 is non-sweat absorbent.

In another discrete variation of the invention, a sweatband segment 270 is uniaxially stretchable.

In yet another discrete variation of the invention, a sweatband segment 270 is biaxially stretchable.

In a distinguishable variation of the invention, each sweatband segment 270 is made from different materials.

In another distinguishable variation of the invention, each sweatband segment 270 is made from the same material.

In yet another distinguishable variation of the invention, each sweatband segment 270 is created from two or more layers. Each sweatband segment layer is shaped as an elongated rectangle with an upper edge, a lower edge, a first edge, a second edge, an inner surface, an outer surface, and a first predetermined width.

The two or more layer sweatband segment has an inner layer 322 and an outer layer 324. The outer surface of the inner layer 322 is attached to the inner surface of the outer layer 324.

In still another distinguishable variation of the invention, each sweatband segment layer is made from a different material than another sweatband segment layer.

In a discernable variation of the invention, each sweatband segment layer is made from the same material.

In another discernable variation of the invention, the inner surface 294 of the inner layer 322 of the sweatband segment layer 270 is made from a material that feels comfortable to a wearer during long term contact with the wearer's skin or hair.

In yet another discernable variation of the invention, the outer surface 310 of the outer layer 326 of the sweatband segment layer 270 is made from a material that feels comfortable to a wearer during long term contact with the wearer's skin or hair.

In still another discernable variation of the invention, each sweatband segment layer is sweat absorbent or non-sweat absorbent.

In a hitherto discernable variation of the invention, the inner layer of each sweatband segment 270 is uniaxially stretchable.

In another hitherto discernable variation of the invention, the inner layer of each sweatband segment 270 is biaxially stretchable.

In yet another apparent variation of the invention, the outer layer of each sweatband segment 270 is uniaxially stretchable.

In still another apparent variation of the invention, the outer layer of each sweatband segment 270 is biaxially stretchable.

In another hitherto apparent variation of the invention, each sweatband segment layer is a different color or the same color as the other the sweatband segment layers.

What is claimed is:

1. A self-sizing baseball cap, comprising:

a plurality of fabric gores of substantially triangular shape, each said fabric gore has a first side, a second side and third side, a crown portion of essentially hemispherical shape being created by attaching said first side of said gore to said second side of another adjacent said gore and so forth until the creation of a closed section of essentially hemispherical shape;

said crown portion has an inner surface and an outer surface and a lower peripheral edge, said lower peripheral edge has a forward portion, a forward midpoint, an aft portion, an aft midpoint and a circumferential linear perimeter of a first predetermined length, said first predetermined length comes in a short and a long length to accommodate a range of head sizes comfortably, said short length being sized to fit small to medium size heads comfortably, said long length being sized to fit large to extra large size heads comfortably;

a visor of an essentially rigid nature being attached to said forward portion of said lower peripheral edge;

a sweatband being provided, said sweatband shaped as an elongated rectangle and has an upper edge, a lower edge, a first edge, a second edge, a forward sweatband midpoint and a first predetermined width, said sweatband being joined at said first edge and said second edge;

said sweatband being attached to said lower peripheral edge so that said forward sweatband midpoint coincides with said forward midpoint and said aft sweatband midpoint coincides with said aft midpoint;

said sweatband being created from two or more layers, each said layer being shaped as an elongated rectangle with an upper edge, a lower edge, a first edge, a second edge, an inner surface, an outer surface, and a first predetermined width;

said two or more layer sweatband has an inner layer and an outer layer, said outer surface of said inner layer being attached to said inner surface of said outer layer; and said attachment of said lower edge of said sweatband to said lower peripheral edge possesses a flexibility which permits said sweatband loop to be in the stowed or deployed position when wearing the self-sizing baseball cap, said stowed position has said outer surface of sweatband flush against said inner surface of said crown portion, said deployed position has said outer surface of said sweatband flush against the head of the wearer of said self-sizing baseball cap.

2. A self-sizing baseball cap according to claim 1 wherein each said sweatband layer being made from different materials.

3. A self-sizing baseball cap according to claim 1 wherein each said sweatband layer being made from the same material.

4. A self-sizing baseball cap according to claim 1 wherein said inner surface of said inner layer of said sweatband being made from a material that feels comfortable to a wearer during long term contact with the wearer's skin or hair.

5. A self-sizing baseball cap according to claim 1 wherein said outer surface of said outer layer of said sweatband being made from a material that feels comfortable to a wearer during long term contact with the wearer's skin or hair.

6. A self-sizing baseball cap according to claim 1 wherein a said sweatband layer being sweat absorbent.

7. A self-sizing baseball cap according to claim 1 wherein a said sweatband layer being non-sweat absorbent.

8. A self-sizing baseball cap according to claim 1 wherein said inner layer being uniaxially stretchable.

9. A self-sizing baseball cap according to claim 1 wherein said inner layer being biaxially stretchable.

10. A self-sizing baseball cap according to claim 1 wherein said outer layer being uniaxially stretchable.

11. A self-sizing baseball cap according to claim 1 wherein said outer layer being biaxially stretchable.

12. A self-sizing baseball cap, comprising:

a plurality of fabric gores of substantially triangular shape, each said fabric gore has a first side, a second side and third side, a crown portion of essentially hemispherical shape being created by attaching said first side of said gore to said second side of another adjacent said gore and so forth until the creation of a closed section of essentially hemispherical shape;

said crown portion has an inner surface and an outer surface and a lower peripheral edge, said lower peripheral edge has a forward portion, a forward midpoint, an aft portion, an aft midpoint and a circumferential linear perimeter of a first predetermined length;

a visor of an essentially rigid nature being attached to said forward portion of said lower peripheral edge;

a sweatband being provided, said sweatband being created from two or more sweatband segments, each said sweatband segment being shaped as an elongated rectangle with an upper edge, a lower edge, a first edge, and a second edge and a first predetermined width;

said first edge of said sweatband segment being attached to said second edge of an adjacent said sweatband segment and so forth to create a closed loop, two or more piece said sweatband, said sweatband has an inner surface, an outer surface and a circumferential linear extent of a first predetermined length;

said sweatband being attached to said lower peripheral edge so that said forward sweatband mid point coincides with said forward midpoint and said aft sweatband midpoint coincides with said aft midpoint;

said attachment of said lower edge of said sweatband to said lower peripheral edge possesses a flexibility which permits said sweatband loop to be in the stowed or deployed position when wearing the self-sizing baseball cap, said stowed position has said outer surface of sweatband flush against said inner surface of said crown portion, said deployed position has said outer surface of said sweatband flush against head of the wearer of said self-sizing baseball cap.

13. A self-sizing baseball cap according to claim 12 wherein said first predetermined length comes in a short and a long length to accommodate a range of head sizes comfortably, said short length being sized to fit small to medium size heads comfortably, said long length being sized to fit large to extra large size heads comfortably.

14. A self-sizing baseball cap according to claim 12 wherein each said sweatband segment being a different color than the other said sweatband segments.

15. A self-sizing baseball cap according to claim 12 wherein all said sweatband segments being the same color.

16. A self-sizing baseball cap according to claim 12 wherein a said sweatband segment being sweat absorbent.

17. A self-sizing baseball cap according to claim 12 wherein a said sweatband segment being non-sweat absorbent.

18. A self-sizing baseball cap according to claim 12 wherein a said sweatband segment being uniaxially stretchable.

19. A self-sizing baseball cap according to claim 12 wherein a said sweatband segment being biaxially stretchable.

20. A self-sizing baseball cap according to claim 12 wherein each said sweatband segment being made from different materials.

21. A self-sizing baseball cap according to claim 12 wherein each said sweatband segment being made from the same material.

22. A self-sizing baseball cap according to claim 12 wherein a said sweatband segment being created from two or more layers, each sweatband segment layer being shaped as an elongated rectangle with an upper edge, a lower edge, a first edge, a second edge, an inner surface, an outer surface, and a first predetermined width;

said two or more layer sweatband segment has an inner layer and an outer layer, said outer surface of said inner layer being attached to said inner surface of said outer layer.

23. A self-sizing baseball cap according to claim 22 wherein each said sweatband segment layer being made from different materials.

24. A self-sizing baseball cap according to claim 22 wherein each said sweatband segment layer being made from the same material.

25. A self-sizing baseball cap according to claim 22 wherein said inner surface said inner layer of said sweatband segment layer being made from a material that feels comfortable to a wearer during long term contact with the wearer's skin or hair.

26. A self-sizing baseball cap according to claim 22 wherein said outer surface of said outer layer of said sweatband segment layer being made from a material that feels comfortable to a wearer during long term contact with the wearer's skin or hair.

27. A self-sizing baseball cap according to claim 22 wherein each said sweatband segment layer being sweat absorbent or non-sweat absorbent.

28. A self-sizing baseball cap according to claim 22 wherein said inner layer of each said sweatband segment being uniaxially stretchable.

29. A self-sizing baseball cap according to claim 22 wherein said inner layer of each said sweatband segment being biaxially stretchable.

30. A self-sizing baseball cap according to claim 22 wherein said outer layer of each said sweatband segment being uniaxially stretchable.

31. A self-sizing baseball cap according to claim 22 wherein said outer layer of each said sweatband segment being biaxially stretchable.

32. A self-sizing baseball cap according to claim 22 wherein each said sweatband segment layer being a different color or the same color as the other said sweatband segment layers.

* * * * *